United States Patent [19]

Harmon et al.

[11] 4,015,910

[45] Apr. 5, 1977

[54] BOLTED PAIRED VANES FOR TURBINE

[75] Inventors: Kenneth E. Harmon, North Palm Beach; John L. Mayers, Lake Park, both of Fla.

[73] Assignee: The United States of America as represented by the Secretary of the Air Force, Washington, D.C.

[22] Filed: Mar. 9, 1976

[21] Appl. No.: 665,216

[52] U.S. Cl. ..... 415/217; 415/219 R

[51] Int. Cl.[2] ..... F01D 1/02

[58] Field of Search ..... 415/216, 217, 218, 136, 415/219 R

[56] References Cited

UNITED STATES PATENTS

| | | | |
|---|---|---|---|
| 1,423,466 | 7/1922 | Snyder | 416/191 |
| 2,851,246 | 9/1958 | Nichols | 415/136 |
| 3,182,955 | 5/1965 | Hyde | 415/216 |
| 3,302,926 | 2/1967 | Bobo | 415/216 |
| 3,363,416 | 1/1968 | Heybyrne et al. | 415/216 |
| 3,764,226 | 10/1973 | Matto | 415/219 R |

FOREIGN PATENTS OR APPLICATIONS

| | | | |
|---|---|---|---|
| 229,090 | 6/1960 | Australia | 415/218 |

*Primary Examiner*—Henry F. Raduazo
*Attorney, Agent, or Firm*—Joseph E. Rusz; Richard J. Killoren

[57] ABSTRACT

A paired vane structure for the first stator stage of a gas turbine, having the vane structure of each vane pair cast in two matching parts which are then assembled and held together by means of bolts passing through flanges on the vane inner and outer platforms. The paired vanes are assembled into the gas turbine structure in the same manner as the prior art paired vane sections.

1 Claim, 8 Drawing Figures

PRIOR ART

BOLTED PAIRED VANES FOR TURBINE

RIGHTS OF THE GOVERNMENT

The invention described herein may be manufactured and used by or for the Government of the United States for all governmental purposes without the payment of any royalty.

BACKGROUND OF THE INVENTION

At present, in some turbine engines, the turbine vanes for the first turbine stage are paired to provide a lighter structure. However, when the pair of vanes are cast as a unit, a casting defect in one of the airfoils requires the scrapping of the whole pair. Also, in these paired vane sections, parts of the airfoils are not accessible for line of sight erosion coating. There is also greater difficulty when using the paired vane sections in the drilling of cooling holes.

BRIEF SUMMARY OF THE INVENTION

According to this invention, the paired vane sections are modified to retain the advantages of the paired vanes and to overcome the disadvantages. The paired vane sections of this invention include two separately cast vanes which are bolted together to form take apart paired vanes. The vane pairs of this invention are assembled into the turbine structure in the same manner as with the prior art paired vane sections.

IN THE DRAWINGS

DETAILED DESCRIPTION OF THE INVENTION

Figure 1:
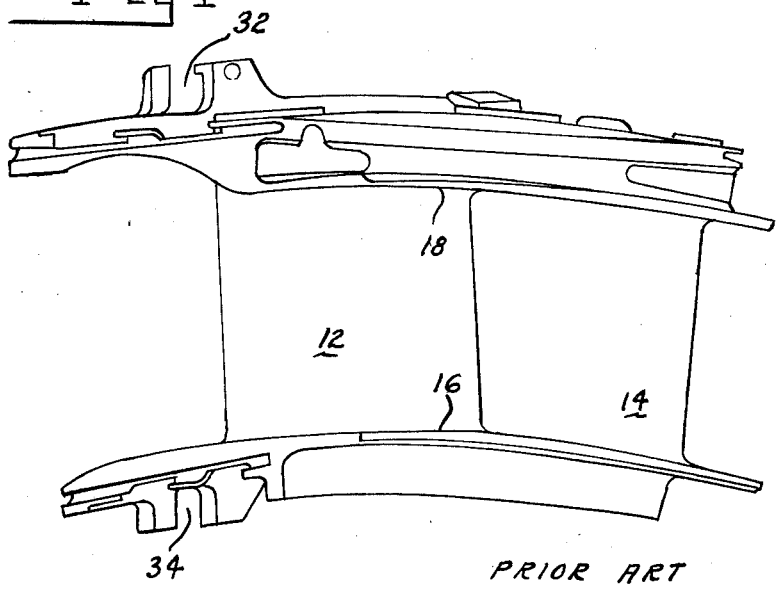
FIG. 1 is an isometric view of a prior art paired vane section for use in the first turbine stage of a gas turbine.
Figure 2:
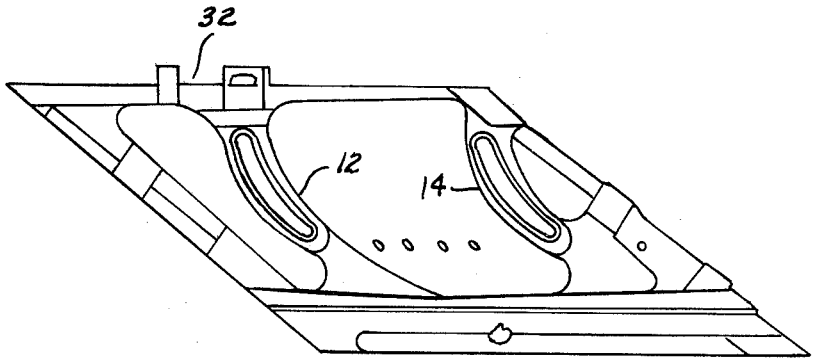
PRIOR ART Fig-2
FIG. 2 is a partially schematic top view of the device of FIG. 1.

Reference is now made to FIGS. 1 and 2 of the drawing which show a prior art paired vane section for use in the first stage of a gas turbine.

Each of the paired vane sections used in the first stator stage of the gas turbine, one of which is shown in FIG. 1, has vanes 12 and 14 positioned between an inner platform 16 and an outer platform 18.

Figure 3:
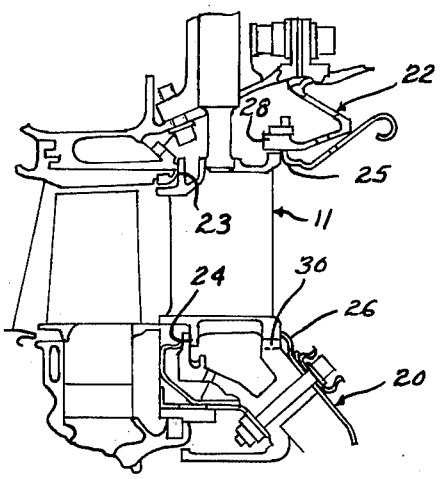
Fig-3 PRIOR ART
FIG. 3 is a partially schematic view of the paired vane section of FIG. 1 as assembled into the gas turbine.
Figure 4:
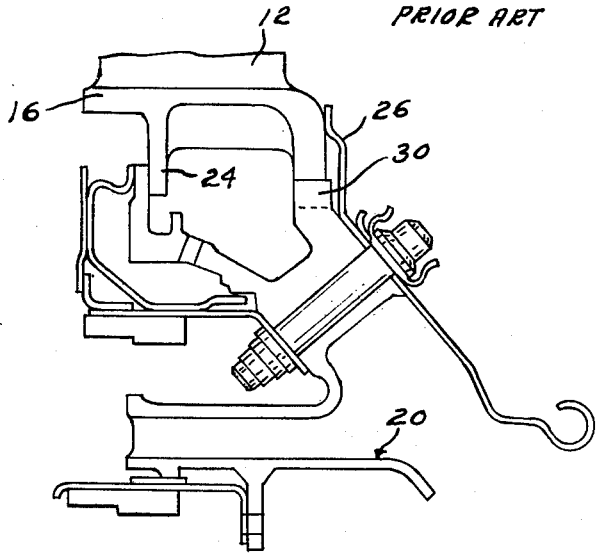
Fig-4 PRIOR ART
FIG. 4 is an enlarged view of a portion of the inner paired vane support assembly shown in FIG. 3.
Figure 5:
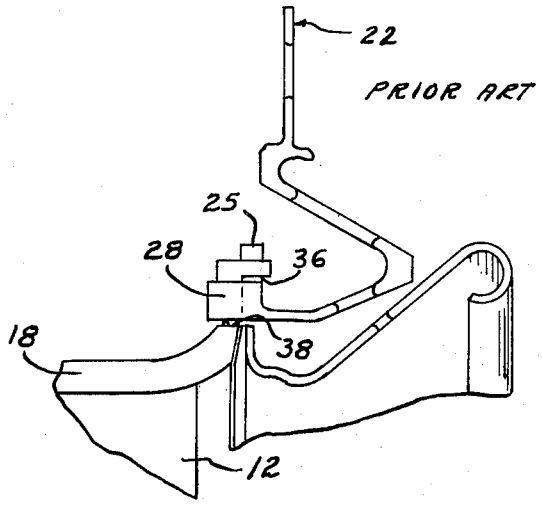
Fig-5 PRIOR ART
FIG. 5 is an enlarged view of a portion of the outer paired vane support assembly shown in FIG. 3.

The paired vane sections are held in place in the turbine engine between the inner stator support assembly 20 and the outer stator support assembly 22 as shown in FIGS. 3–5. The paired vane sections are held axially by flanges 23 and 24 and retainers 25 and 26. The paired vane sections are held circumferentially by projections 28 and 30 which fit into slots 32 and 34, shown more clearly in FIG. 1. The surfaces at 36 and 38 provide radial retention of the paired vane sections.

Figure 6:
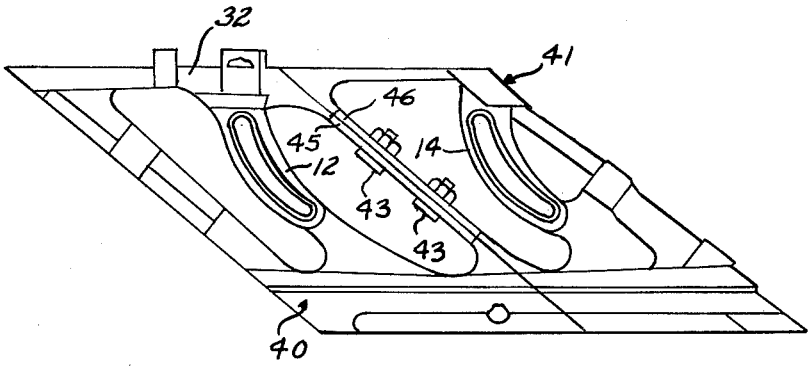
FIG. 6 is a partially schematic top view of the paired vane section, as shown in FIG. 2, modified according to this invention.
Figure 7:
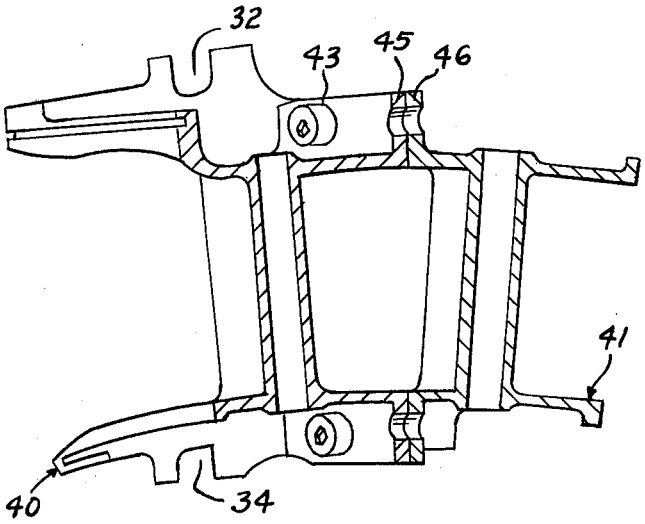
FIG. 7 is a sectional view of the device of FIG. 6 taken along the line 7—7.
Figure 8:
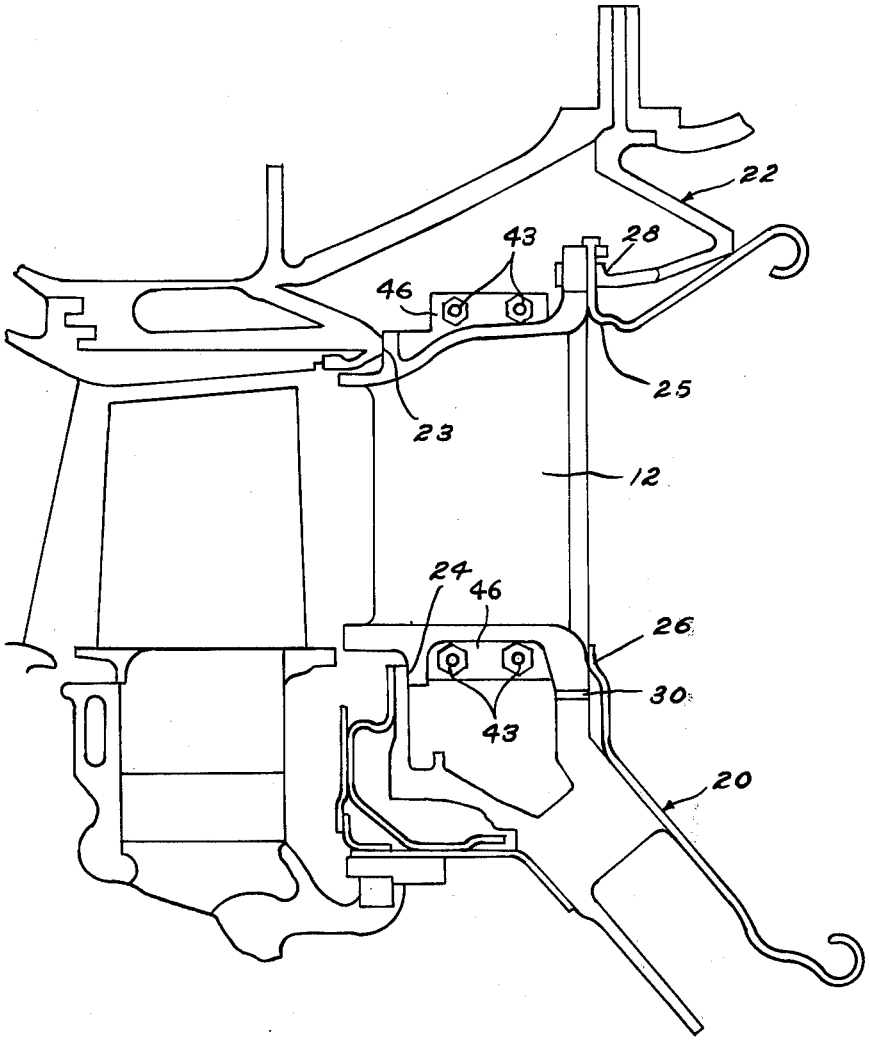
FIG. 8 is an enlarged partially schematic view showing the paired vane sections of FIGS. 6 and 7 assembled into a gas turbine as in the device of FIG. 3.

According to this invention, the paired vanes of FIGS. 1–3 are modified as shown in FIGS. 6 and 7. The paired vane sections are cast in two mating parts 40 and 41. After the two parts have been cast and treated, the two sections are bolted together with bolts 43, which pass through flanges 45 and 46 to provide paired vane sections similar to that shown in FIGS. 1 and 2. The paired assemblies are then secured in place in the turbine engine, in the same manner as described above with respect to FIGS. 3–5.

There is thus provided paired vane assemblies for use in the first stage of a gas turbine which has the advantages of prior art paired vane sections without the disadvantages present when the paired vane sections are cast as a unit.

We claim:

1. In the first stage of a gas turbine having an inner stator support assembly; an outer stator support assembly; a plurality of paired vane sections; means for circumferentially retaining the paired vane sections between the inner and outer stator support assemblies; means for axially retaining said paired vane sections and means for radially retaining the said paired vane sections; said paired vane sections comprising first vane members each including a turbine vane and an inner and outer vane platform; second vane members each including a vane and an inner and outer vane platform; said inner and outer vane platform of the first and second vane members including means for interconnecting the first and second vane members; said means for interconnecting the first and second vane members including flanges on the inner and outer vane platforms of the first vane members and flanges on the inner and outer vane platforms of the second blade members and means for removably securing the flanges of the first vane members to the flanges of the second vane members.

* * * * *